250-506.1
5/8/84 OR 4,447,733

United States Patent [19]
Baatz et al.

[11] 4,447,733
[45] May 8, 1984

[54] RADIATION-SHIELDING TRANSPORT AND STORAGE CONTAINER AND METHOD OF PACKAGING RADIOACTIVE MATERIAL

[75] Inventors: Henning Baatz; Dieter Rittscher, both of Essen; Jürgen Wriegt, Heiligenhaus, all of Fed. Rep. of Germany

[73] Assignee: GNS Gesellschaft für Nuklear-Service mbH, Essen, Fed. Rep. of Germany

[21] Appl. No.: 279,332

[22] Filed: Jul. 1, 1981

[30] Foreign Application Priority Data

Jul. 8, 1980 [DE] Fed. Rep. of Germany ..... 3025795

[51] Int. Cl.[3] ..... G21F 5/00
[52] U.S. Cl. ..... 250/506.1
[58] Field of Search ..... 250/506.1, 507.1; 376/272

[56] References Cited

U.S. PATENT DOCUMENTS

| | | | |
|---|---|---|---|
| 3,982,134 | 9/1976 | Houshelder et al. | 250/506.1 |
| 4,197,467 | 4/1980 | Williams | 250/506.1 |
| 4,274,007 | 6/1981 | Boatz et al. | 250/506.1 |

*Primary Examiner*—Bruce C. Anderson
*Attorney, Agent, or Firm*—Karl F. Ross; Herbert Dubno

[57] ABSTRACT

A package for radioactive material which comprises a radiation-absorbing vessel having a plug-type inner cover sealingly engaging this vessel and an outer security cover overlying the massive plug-type cover and defining a clearance therewith in which gas can be monitored to detect failure of the seal, this safety cover being sealed to the vessel so that the latter chamber is sealed from the atmosphere. According to the invention, this chamber is sealed with gas at a superatmospheric pressure which is also above the pressure within the vessel and the pressure of the chamber is monitored, a drop in pressure signaling a breach either of the seal between the plug-type cover and the interior of the vessel or between the safety cover and the vessel.

7 Claims, 1 Drawing Figure

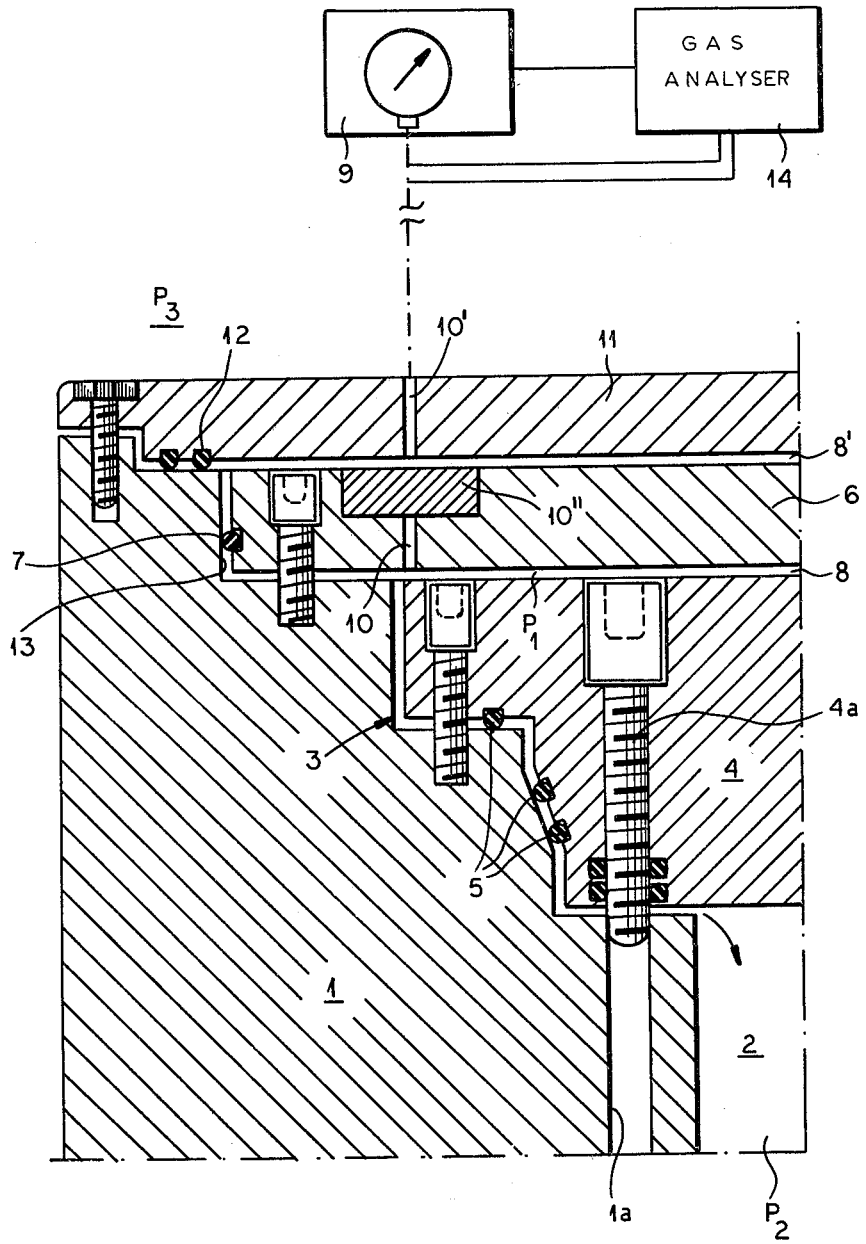
GAS
ANALYSER
9
14
P3
12
10'
11
8'
6
10"
7
8
13
10
P1
4a
3
4
5
1
2
1a
P2

RADIATION-SHIELDING TRANSPORT AND STORAGE CONTAINER AND METHOD OF PACKAGING RADIOACTIVE MATERIAL

CROSS REFERENCE TO RELATED APPLICATIONS

The present application is related to our application Ser. No. 243,627 filed Mar. 13, 1981 as well as to the commonly assigned copending application Ser. No. 243,562 filed Mar. 13, 1981 by two of the present joint inventors and which is in turn related to an application Ser. No. 120,108 filed Feb. 8, 1980 (now U.S. Pat. No. 4,274,007), Ser. No. 966,951 filed Dec. 6, 1978 (now U.S. Pat. No. 4,278,892) and Ser. No. 940,856 of Sept. 8, 1978 (now U.S. Pat. No. 4,272,683). Certain of these applications were copending with application Ser. No. 940,098 corresponding to U.S. Pat. No. 4,234,798 and Ser. No. 107,276 filed Sept. 26, 1979 (now U.S. Pat. No. 4,288,698). Still earlier related applications culminated in U.S. Pat. Nos. 4,229,316 and 4,235,739 which are also considered material to the present application.

For the construction of radiation-shieldng transport and storage containers, for details as to the radiation-shielding properties thereof and for the use of such vessels, these commonly owned prior applications and patents are hereby incorporated by reference in their entirety and it is noted that the prior art known to applicants to be the most relevant is the prior art represented by these patents to the extent that they are prior art, and the art of record of said applications.

FIELD OF THE INVENTION

Our present invention relates to radiation-shielding transport and storage containers and, more particularly, to containers for the transport and storage of radioactive materials which are capable of absorbing radiation from the packaged material and hence prevent significant escape of radiation into the environment.

The invention also relates to an improved method of packaging such material.

BACKGROUND OF THE INVENTION

From the aforementioned patents and the art mentioned therein it is known to provide for the transport and storage of radioactive wastes, containers or vessels of radiation-shielding material and which may be provided with channels or compartments to contain radiation-blocking and radiant-energy-attenuating material and with ribs or the like to promote heat exchange with ambient air.

Radioactive material can be placed in such containers and sealed by cover arrangements including a shielding cover which can have a plug configuration, i.e. which is comparatively massive so that it functions as a radiation-absorbing wall, the seal between this cover and the vessel being labyrinth or multiple seal having sealing rings between surfaces which are stepped or at angles to one another to minimize the probability that a radio nucleide particle can pass between the cover and the vessel and thereby escape.

The vessel can have a mouth formed with a recessed seat receiving the plug-type inner cover which can have a frustoconical portion and a cylindrical portion fitting into correspondingly shaped parts of the seat and sealed relative to the latter with elastomeric seals, generally O-rings.

Above this inner cover, an outer cover was mounted on the vessel as a protective member. Seals could be provided between this outer cover and the vessel as well and an important feature in the packaging of the radioactive material was the including of a control gas whose composition could be monitored or "sniffed" to verify the security of the seals.

Between the outer cover and the inner cover, therefore, a control space was provided and this space was monitored to detect the stability of the seal.

Both the vessel and the plug-type cover can be composed of cast iron, especially spherolytic cast iron or cast steel and the plug-type cover can be sealed to the vessel with an inner seal which can be of the single-stage or multiple-stage type.

The safety cover, which is disposed above the shielding cover and defines a control-gas compartment therewith, is formed with the outer seal and can be overlain by a further protective cover, if desired.

While packaging of the afordescribed type has proved to be effective for the transportation and long term storage of radioactive waste, monitoring of the integrity of the package, i.e. the integrity of the seals, has required monitoring of the presence in the control-gas compartment of radioactive species whose presence can signal a defect in the inner seal.

Repair of the system, by removal of the outer cover, removal of the safety cover, and resealing the plug-type cover may result in release of any radioactive components in the control space between the safety cover and the plug-type cover.

Furthermore, the detection of a failure is effected by analytical means requiring sniffing with sensitive species-discriminating detectors which may not always be reliable.

Earlier techniques did not adequately signal a failure of the outer seal, i.e. the seal between the atmosphere and the control space.

OBJECTS OF THE INVENTION

It is the principal object of the present invention to provide an improved radiation-shield transport and storage container whereby the disadvantages described above are eliminated and, especially, the integrity of the seals can be maintained with less danger of release of radioactive species into the environment, with greater reliability and with the capacity to discriminate between failure of the outer seal or the inner seal.

Another object of this invention is to provide an improved method of packaging radioactive wastes so that a failure or defect in the inner seal can be detected long before radioactive gases or vagabond radioactive species or gas containing same can enter the control space or the gas barrier compartment between the plug-type cover and the safety cover.

SUMMARY OF THE INVENTION

These objects and others which will become apparent hereinafter are obtained in accordance with the present invention in a container of the aforedescribed type, i.e. comprising a thick-wall vessel of spherolytic cast iron or cast steel, a plug-type absorption cover recessed in the mass of this vessel and provided with a multiple seal thereagainst, the multiple seal forming an inner seal and a safety cover fitted into the vessel and sealed thereagainst by the outer seal whereby the safety cover defines a control space with the plug-type seal.

According to the invention, the control gas in the control or barrier space is sealed in the latter with a pressure significantly greater than the pressure in the storage compartment of the vessel and greater than atmospheric pressure, the container being provided with a monitoring device which responds to a pressure drop in the control gas in this compartment below a particular determined threshold value.

When the storage chamber of the vessel is at a pressure of 0.8 to 1.5 bar, the control gas can be provided with pressure of 6 bar. Under these conditions the failure of the inner seal will result in the induction of control gas through the failed seal into the interior of the vessel from the control space. This is because the pressure in this space is higher than that in the vessel and the volume of the control space is small by comparison to the volume in the vessel. As a consequence the pressure in the control space will drop sharply and this drop in pressure can signal an alert.

Of course, a pressure drop to atmospheric pressure will signal a failure of the outer seal as well. Naturally, the compartment can be "sniffed", (i.e. subjected to gas analysis by a species-sensitive detector) upon the detection of such a pressure drop to facilitate determination of whether it is the inner seal or the outer seal which has become defective.

If an inner seal failure is detected, an additional cover can be applied so that the previous outer barrier then forms an inner barrier while the additional cover provides an outer barrier. A failure of the outer seal is extraordinary but is readily repaired by removal of the outer cover and the sealing cover and replacement of the sealing elements.

Any release of radioactive material into the environment will be minimum because of the small size of the barrier compartment.

BRIEF DESCRIPTION OF THE DRAWING

The above and other objects, features and advantages will become more readily apparent from the following description reference being made to the accompanying drawing in which the sole FIGURE is a fragmentary section through the covers and mouth of a storage and transport container according to the invention.

SPECIFIC DESCRIPTION

As can be seen from the drawing, the vessel is formed by a unitary one-piece body 1 of cast iron especially spherolytic cast iron, or cast steel and can serve to receive irradiated nuclear-reactor fuel elements. This container can have the construction of the containers of the above-identified applications and patents.

The mouth of the container is stepped to form a recessed seat 3 in which a cast iron or cast steel plug-type absorbing or shielding cover 4 is received with elastomeric sealing rings 5 forming a multiple barrier collectively referred to hereinafter as the inner seal. A passage 1*a* running through the wall of the container can be closed by a plug formed by a screw 4*a* threaded into the cover and sealed relative thereto. The storage chamber 2 of the vessel is thus completely sealed against the exterior.

Above the cover 4, a safety cover 6 is mounted in a seat 13 and is sealed as shown at 7 by a single 0-ring seal forming the outer seal of the invention. Between the inner seal 5 and the outer seal 7, the barrier compartment 8 is formed which can be filled with a control gas. The barrier compartment 8 communicates with a monitoring device represented diagrammatically at 9 as a gauge but including a threshold-responsive circuit which, upon detention of a pressure drop below a given threshold, can operate a gas analyser 14 which is capable of detecting species in the gas from compartment 8 and signaling whether these species include radioactive species from the chamber 2 of the vessel or species from the ambient atmosphere.

A bore 10 serves to communicate between the compartment 8 and the device 9.

When a further cover 11 is provided, an additional bore 10' may be formed in this cover and a hole drilled in a welded plate 10'' to permit communication through this plate with the compartment 8 via a tube sealingly fitted through the holes. When, however, the cover 6 blocks the inner cover because of a failure of the inner seal 5, an intact plate 10'' is welded in place and the compartment 8' becomes the new pressurized control compartment such that seal 7 becomes the inner seal and seal 12 the outer seal.

The control gas in compartment 8 is at a pressure $p_1$ which is significantly higher than the pressure $p_2$ in the storage chamber 2 and than the atmospheric pressure $p_3$. The pressure in chamber 2 ($p_2$) is preferably 0.8 to 1.5 bar while the pressure $p_1$ is about 6 bar. If the inner seal 5 fails, control gas flows in the direction of the arrow into the chamber 2 and the pressure in compartment 8 falls. This pressure drop is signaled by the monitoring device and can trigger an alarm to initiate repair proceedings.

Preferably when the pressure drop falls below a predetermined threshold, the circuit 9 provides a continuous or periodic read-out of the pressure in compartment 8.

We claim:

1. A radiation-shielding transport and storage container for radioactive material, said container comprising:

a radiation shielding vessel composed of cast iron or cast steel and defining a storage chamber for said radioactive material and a mouth opening into said chamber and formed with a plurality of seats;

a plug-type radiation-shielding cover received in one of said seats and sealed with respect to said vessel by an inner seal;

a safety cover speced outwardly from said shielding cover, received in another of said seats and sealed with respect to said vessel by an outer seal whereby said covers define a control space between said inner and outer seal containing gas at a pressure significantly higher than that in said chamber and than atmospheric pressure; and pressure-monitoring means communicating with said space and responsive to a drop in the pressure therein below a predetermined threshold value for signaling a failure of one of said seals.

2. The container defined in claim 1 wherein the pressure in said space is about 6 bar and the pressure in said chamber is between 0.8 and 1.5 bar.

3. The container defined in claim 1 or claim 2 wherein a further cover is mounted on said vessel and sealed relative thereto above said safety cover.

4. The container defined in claim 3 wherein said shielding cover has a frustoconical inner portion and cylindrical outer portion overhanging said inner portion, said outer portion forming a shoulder, said inner seal including sealing rings between each of said portions and said vessel.

5. The container defined in claim 4 wherein said shielding cover and said vessel are composed of spherolytic cast iron.

6. A method of packaging radioactive material which comprises the steps of:

(a) introducing radioactive material into the chamber of the cast iron or cast steel vessel having a wall thickness sufficient to prevent escape of radiation through the walls of said vessel;

(b) sealing a radiation-absorbing cover in said vessel;

(c) sealing a safety cover to said vessel above said radiation-absorbing cover establishing a control space between said covers which is sealed by said covers from the interior of said vessel and the atmosphere respectively;

(d) pressurizing said space with gas at a pressure established above the pressure in the interior of said vessel and above atmospheric pressure; and (e) monitoring the pressure in said space and signaling the failure of a seal of one of said covers upon the monitor pressure dropping below a predetermined threshold value.

7. A method of operating a transport and storage vessel for radioactive waste which comprises introducing radioactive material into a chamber of a cast iron or steel vessel having a wall thickness sufficient to prevent escape of radiation therefrom;

inserting a plug into said vessel of a thickness sufficient to prevent radiation from escaping through said plug while sealing said chamber with at least one inner seal formed between said plug and said vessel;

disposing on said vessel above said plug a safety cover and sealing said safety cover to said vessel with at least one outer seal;

establishing a pressure within said chamber of substantially 0.8 to 1.5 bar;

establishing with the compartment defined between said cover and said plug and between said inner and outer seals a pressure of substantially 6 bar; and monitoring the pressure in said compartment to detect a change in pressure representing a breach of one of said seals, thereby enabling corrective action.

* * * * *